US011779799B2

(12) United States Patent
Miller et al.

(10) Patent No.: US 11,779,799 B2
(45) Date of Patent: Oct. 10, 2023

(54) EXERCISE HANDLE

(71) Applicant: Proteus Motion Inc., Brooklyn, NY (US)

(72) Inventors: Samuel Adam Miller, Mount Pleasant, SC (US); Paul Joseph Vizzio, New York, NY (US); Michael Anthony Charpin, Brooklyn, NY (US); William Cowles, Brooklyn, NY (US)

(73) Assignee: Proteus Motion Inc., Brooklyn, NY (US)

( * ) Notice: Subject to any disclaimer, the term of this patent is extended or adjusted under 35 U.S.C. 154(b) by 0 days.

(21) Appl. No.: 17/516,370

(22) Filed: Nov. 1, 2021

(65) Prior Publication Data

US 2022/0143455 A1 May 12, 2022

Related U.S. Application Data

(60) Provisional application No. 63/112,915, filed on Nov. 12, 2020.

(51) Int. Cl.
*A63B 21/00* (2006.01)
*A63B 23/12* (2006.01)

(52) U.S. Cl.
CPC ..... *A63B 21/4035* (2015.10); *A63B 21/4047* (2015.10); *A63B 21/4049* (2015.10); *A63B 23/12* (2013.01)

(58) Field of Classification Search
CPC ..... A63B 21/00058; A63B 21/00069; A63B 21/00072; A63B 21/00076;
(Continued)

(56) References Cited

U.S. PATENT DOCUMENTS 3,203,009 A * 8/1965 Olaf ..... B66C 23/48 5/87.1
4,221,516 A * 9/1980 Haaker ..... B25J 3/00 414/6

(Continued)

FOREIGN PATENT DOCUMENTS

FR 2805076 B1 5/2002
KR 101553051 B1 9/2015

OTHER PUBLICATIONS

International Search Report and Written Opinion for PCT/US2021/072150, entitled: Exercise Handle, dated Feb. 28, 2022.

*Primary Examiner* — Sundhara M Ganesan
*Assistant Examiner* — Zachary T Moore
(74) *Attorney, Agent, or Firm* — Hamilton, Brook, Smith & Reynolds, P.C.

(57) ABSTRACT

An exercise handle including a rotatable handle member pivotably connected between two side members by two handle member side pivots. A parallel bar member can be pivotably connected between the two side members spaced away and parallel to the handle member. The parallel bar member can be connected between the two side members by two bar member side pivots. A central support member can be pivotably connected to the parallel bar member by a central pivot, providing the handle member with side to side tilting relative to the central support member. A central joint can be connected to the central support member for connecting to an exercise device.

16 Claims, 11 Drawing Sheets

(58) Field of Classification Search
CPC ..... A63B 21/00178; A63B 21/00181; A63B 21/00192; A63B 21/005; A63B 21/0051; A63B 21/0056; A63B 21/0057; A63B 21/0058; A63B 21/0059; A63B 21/0083; A63B 21/0085; A63B 21/0087; A63B 21/15; A63B 21/158; A63B 21/159; A63B 21/4041; A63B 21/4045; A63B 21/4047; A63B 21/4049
See application file for complete search history.

(56) References Cited

U.S. PATENT DOCUMENTS 4,629,185 A 12/1986 Amann
5,755,645 A 5/1998 Miller et al.
5,787,593 A 8/1998 Althaus
5,830,160 A * 11/1998 Reinkensmeyer ..... A61B 5/224 600/595
6,457,700 B1 * 10/2002 Hong ..... B66C 23/48 254/8 B
6,592,498 B1 7/2003 Trainor
6,921,352 B1 * 7/2005 Stearns ..... A63B 23/14 482/44
7,108,641 B2 9/2006 Pertegaz-Esteban
7,837,599 B2 * 11/2010 Kowalczewski ..... A63B 23/12 482/904
7,935,028 B2 5/2011 Ketomäki
9,061,177 B1 * 6/2015 Singh ..... A63B 21/4047
9,662,531 B2 5/2017 Giannelli et al.
10,426,995 B1 * 10/2019 Fiocchi ..... A63B 23/03508
10,456,615 B1 10/2019 Anthony
10,888,732 B2 1/2021 Miller et al.
2006/0040802 A1 2/2006 Vittone et al.
2008/0153682 A1 * 6/2008 Chen ..... A63B 21/4035 482/136
2008/0203696 A1 8/2008 Akagi
2010/0113233 A1 * 5/2010 Chen ..... A63B 21/4047 482/133
2012/0058867 A1 * 3/2012 Mishan ..... A63B 21/4049 482/140
2013/0042719 A1 2/2013 Tuma
2015/0360071 A1 * 12/2015 Lee ..... A63B 23/1281 482/121
2020/0222753 A1 7/2020 Schranz

* cited by examiner

EXERCISE HANDLE

RELATED APPLICATIONS

This application claims the benefit of U.S. Provisional Application No. 63/112,915, filed on Nov. 12, 2020. The entire teachings of the above application(s) are incorporated herein by reference.

BACKGROUND

In known systems, some exercise handles for exercise devices can be complex, expensive and/or prone to failure when subjected to high loads.

SUMMARY

The present disclosure provides an exercise handle that can be used with a 6 degree of freedom exercise device, and can have a design that can withstand high loads. The exercise handle can include a rotatable handle member pivotably connected between two side members by two handle member side pivots. A parallel bar member can be pivotably connected between the two side members spaced away and parallel to the handle member. The parallel bar member can be connected between the two side members by two bar member side pivots. A central support member can be pivotably connected to the parallel bar member by a central pivot, providing the handle member with side to side tilting relative to the central support member. A central joint can be connected to the central support member for connecting to an exercise device.

In particular embodiments, two parallel bar members can be pivotably connected between the two side members and spaced away and parallel to the handle member. Each parallel bar member can be connected between the two side members by two respective bar member side pivots, and to the central support member by respective central pivots. The two parallel bar members can be spaced apart from each other in a parallel manner, and the respective bar member side pivots and central pivots corresponding to each parallel bar member can be aligned along respective common bar member axes. The central support member can include at least one clearance recess for allowing each parallel bar member to extend through the central support member and tilt side to side therein. The handle member side pivots connected to the handle member and the bar member side pivots connected to each parallel bar member on each side member, can be aligned along respective common side member axes. The handle member and the two parallel bar members can remain parallel to each other when tilting side to side. The central joint can provide at least one of rotation about a rotational axis, or connection to a component that provides rotation about the rotational axis.

The present disclosure can also provide an exercise handle including a rotatable handle member pivotably connected between two side members by two site pivots. Two parallel bar members can be pivotably connected between the two side members spaced away and parallel to the handle member. Each parallel bar member can be connected between the two side members by two side pivots. A central support member can be pivotably connected to each parallel bar member by a central pivot, providing the handle member with side to side tilting relative to the central support member. A central joint can be connected to the central support member for providing rotation about a rotational axis, whereby the exercise handle can have three rotational degrees of freedom.

The present disclosure can also provide a method of exercise including gripping and rotating a handle member of an exercise handle that is attached to an exercise device. The rotatable handle can be pivotably connected between two side members by two handle member side pivots. A parallel bar member can be pivotably connected between the two side members by two bar member side pivots, and spaced away and parallel to the handle member. The handle member can be tilted side to side relative to a central support member. The central support member can be pivotably connected to the parallel bar member by a central pivot, and connected by a central joint to the exercise device.

In particular embodiments, two parallel bar members can be tilted side to side that are pivotably connected between the two side members, and spaced away and parallel to the handle member. Each parallel bar member can be connected between the two side members by two respective bar member side pivots, and to the central support member by respective central pivots. During exercise, the two parallel bar members can remain spaced apart from each other in a parallel manner, and the respective bar member side pivots and central pivots corresponding to each parallel bar member can be aligned along respective common bar member axes. The central support member can include at least one clearance recess for allowing each parallel bar member to extend through the central support member and tilt side to side within the at least one clearance recess. The handle member side pivots connected to the handle member and the bar member side pivots connected to each parallel bar member on each side member, can be aligned along respective common side member axes. The handle member and the two parallel bar members can remain parallel to each other when tilting side to side. The exercise handle can be rotated relative to a rotational axis extending from the exercise handle to the exercise device. The central joint can provide at least one of rotation about the rotational axis, or connection to a component that provides rotation about the rotational axis.

BRIEF DESCRIPTION OF DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

Embodiments of the exercise handle in the present disclosure can be used with the exercise devices described in U.S. Pat. Nos. 5,755,645, 9,861,856, 10,888,732, and published patent application No. US 2021/0291010, the contents and teachings of which are incorporated herein in their entirety.

Figure 1:
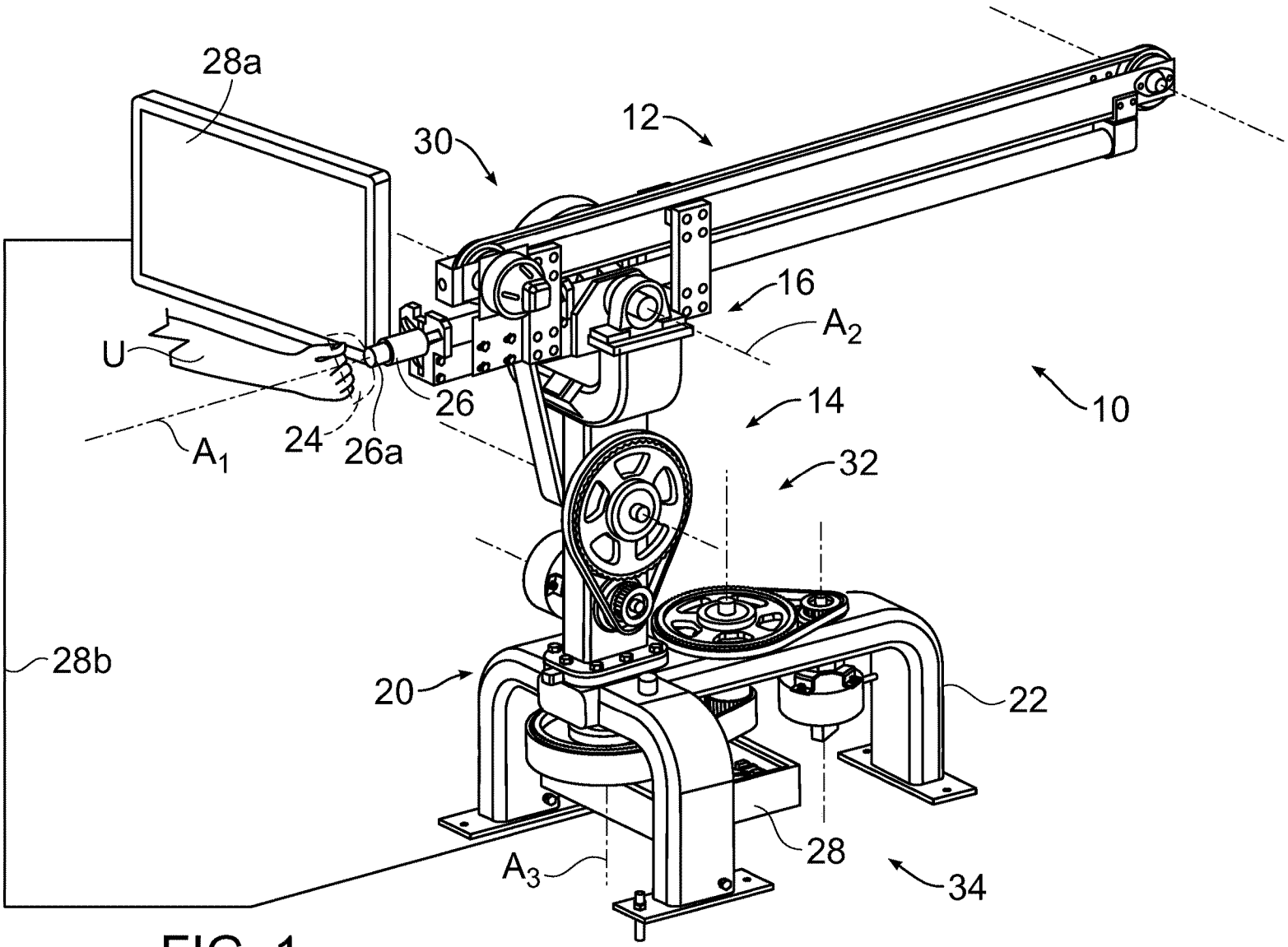
FIG. 1 is a perspective view of an embodiment of an exercise device with an exercise handle in the present disclosure.
Figure 2:
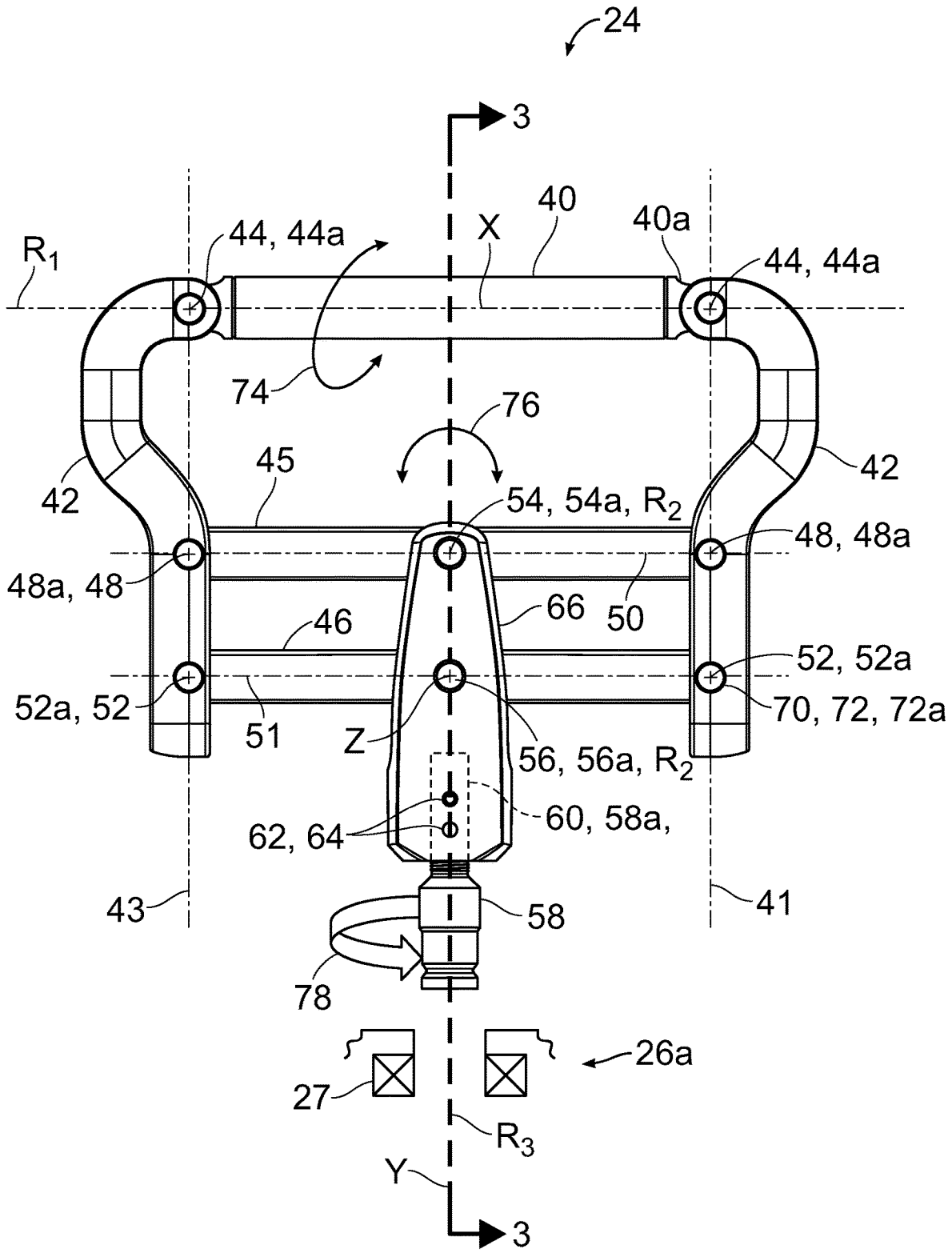
FIG. 2 is a plan view of an embodiment of an exercise handle in the present disclosure.

Referring to FIGS. 1 and 2, a single hand exercise handle design in the present disclosure can solve many issues of previous designs specifically around cost, complexity, ease of use, and range of motion. Embodiments of the design can consist of two outer plates or side members, a central mounting plate or support member, two parallel bars or members, and a rotating handle member. There can also be fasteners, bushings, shafts, and other fasteners to assemble everything. Each mounting point can act as a hinged linkage and allow rotational freedom.

Figure 5:
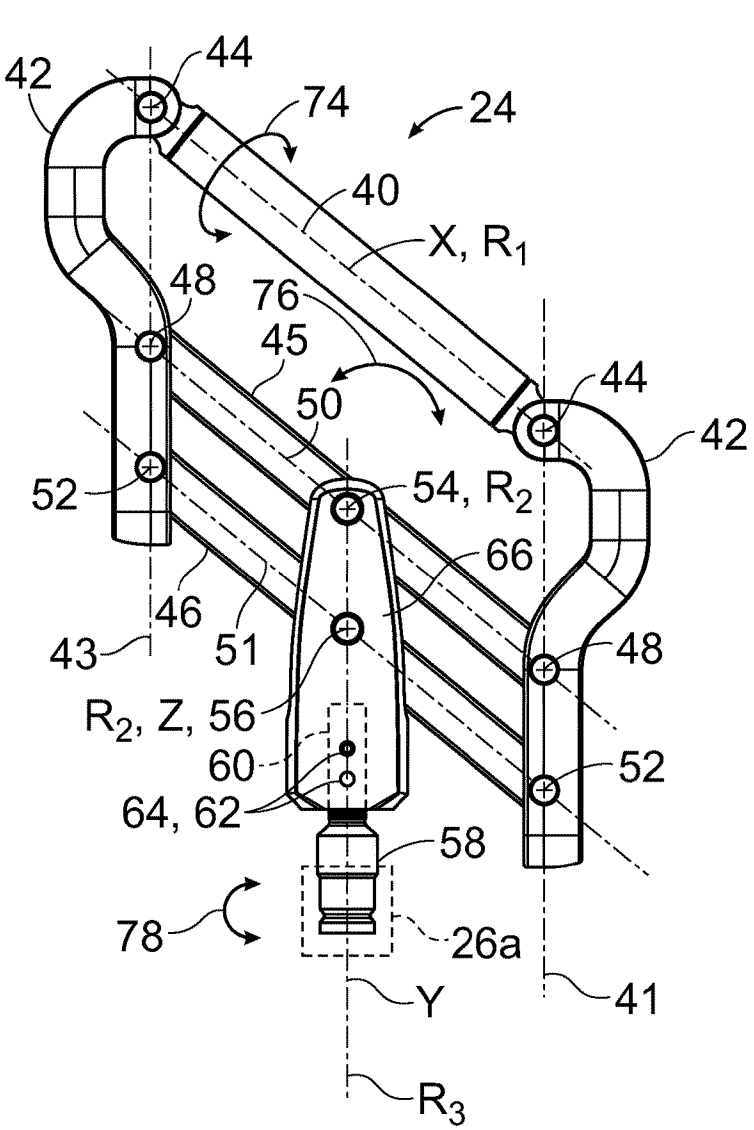
FIGS. 4 and 5 are plan views of the exercise handle tilted to the left and to the right.
Figure 4:
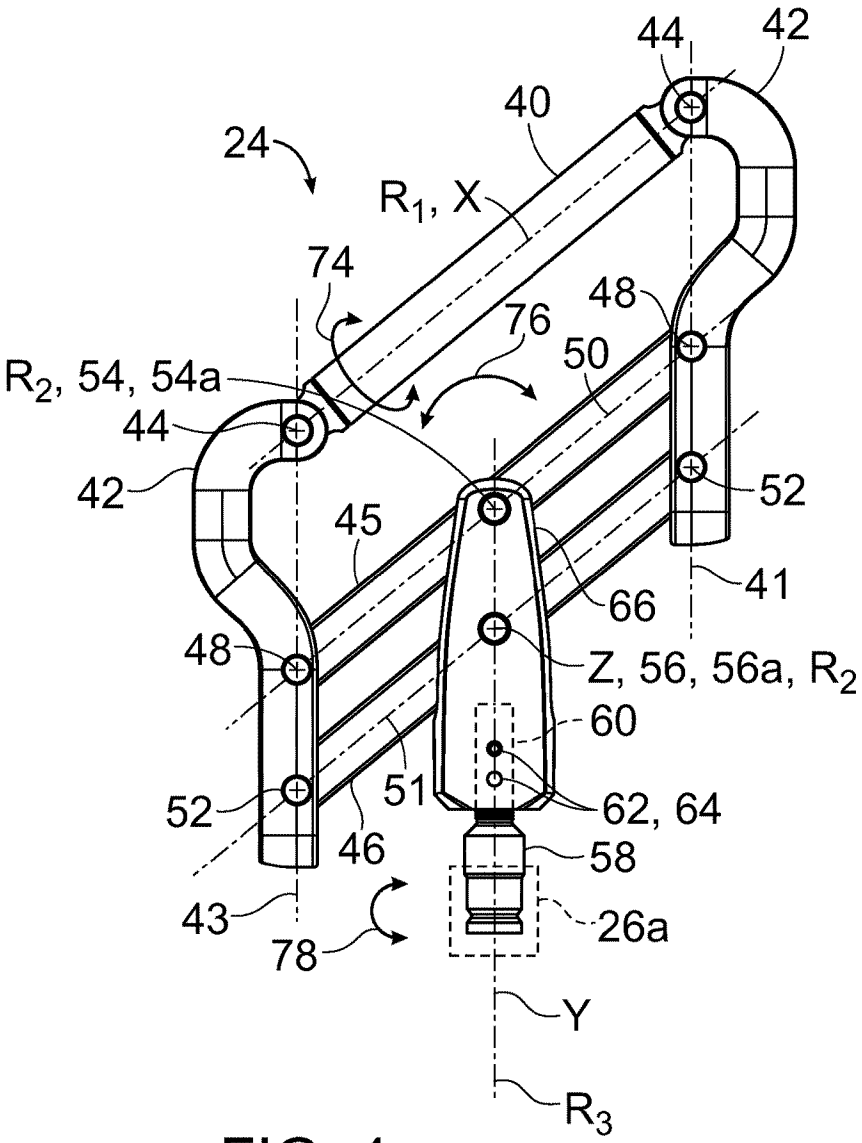

Considering 3D space wherein Y is up/down, X is left/right, and Z is out of/into the page. There is rotational freedom about the Z axis through the 2× parallel bars and the mounted handle member 40 (FIGS. 2, 4 and 5).

There is also rotational freedom about the X axis through the handle member 40. This can be a urethane/plastic/rubber tube loosely mounted on top of a shaft. This allows rotational movement in the handle (see FIG. 2 and the cross section at the Y-Z plane of FIG. 3).

The third rotational freedom can be associated with the joining connector 58 to the exercise device arm. The arm can contain a sleeve bearing which makes this connector 58 rotatable about the arm.

Referring to FIG. 1, in the present disclosure, embodiments of a limb interface or exercise handle 24, can be part of or connected to an exercise device, machine or apparatus 10, such as a 6 degree of freedom computer controlled exercise and/or assessment device. Exercise device 10 in the present disclosure can have a linear arm portion 12 with a reciprocating linear arm member 26 extending along a linear axis $A_1$, to which embodiments of the exercise handle 24 can be attached.

The linear arm portion 12 can be rotatably connected to a torso portion 14 by a rotary shoulder joint 16 about a horizontal axis $A_2$. The torso portion 14 can be rotatably connected to a base or base portion 22 by rotary waist joint 20 about a vertical axis $A_3$. Linear resistance of the arm member 26 can be provided by an arm brake assembly 30, rotary resistance of the shoulder joint 16 can be provided by a shoulder brake assembly 32, and rotary resistance of the waist joint 20 can be provided by a waist brake assembly 34. Control of the brakes within brake assemblies 30, 32 and 34 can be provided by a controller 28, which can be connected to an interface screen 28*a* via a line 28*b* or by wireless. The exercise handle 24 can be grasped by the hand of the user U to conduct 6 degree of freedom exercises on the exercise device 10. Exercise device 10 can be that described in published patent application No. US 2021/0291010, or other suitable devices, including those in the patents previously mentioned above.

Referring to FIGS. 2-5, exercise handle 24 can provide pivoting or rotation about three directions or axes X, Y and Z, as indicated by arrow 74, 76 and 78. A rotatable grip or handle member 40 can be rotatably mounted about an inner axel or grip core 40*b* about a longitudinal handle member axis X. In some embodiments, handle member 40 can be a polymeric or rubber tube. Two axel end caps 40*a* can be attached to the inner axel 40*b* and can be rotationally or pivotably coupled or connected between the distal ends of two side members or periphery housings 42 by two handle member side pivots 44, each extending about an axis 44*a* on each side number 42. Axes 44*a* can extend in the Z axis direction, and can be aligned with each other along axis X and intersect axis X orthogonally.

At least one pivoting parallel bar or bar member 45 and 46, such as two spaced parallel bar members 45 and 46, can be rotationally or pivotably coupled or connected between the two side members 42 and spaced in a parallel manner from each other and the handle member 40. A first parallel bar member 45 can extend along a longitudinal bar or bar member axis 50 that is parallel to axis X, and can be spaced apart from the handle member 40 a distance sufficient to provide room for the user's U hand to grasp the handle member 40, for example in some embodiments, there can be about 4¾ inches between axes X and 50. The second parallel bar member 46 can extend along a longitudinal bar or bar member axis 51 that is parallel to both axes X and 50, and can be spaced from the first parallel bar number 45 by a distance that provides suitable structural strength and rigidity, for example in some embodiments, axis 51 can be about 2¼ inches from axis 50 and about 7 inches away from axis X. Parallel bar member 45 can be pivotably coupled or connected between side members 42 by two bar member side pivots 48, with a bar member side pivot 48 extending along an axis 48*a* on each side member 42. Axes 48*a* can extend in the Z axis direction, and can be aligned with each other along axis 50 and intersect axis 50 orthogonally. The second parallel bar member 46 can be pivotably coupled or connected between the side members 42 by two bar member side pivots 52, with a side pivot 52 extending along an axis 52*a* on each side member 42. Axes 52*a* can extend in the Z axis direction, and can be aligned with each other along axis 51 and intersect axis 51 orthogonally. The handle member pivots 44 and axes 44*a* of the handle member 40 can be aligned with the bar member pivots 48 and 52 and respective axes 48*a* and 52*a* of the parallel bar members 45 and 46 along respective common side member axes 43 and 41 on each side member 42. Axes 43 and 41 can be parallel to each other. The pivots 44, 48 and 52 can be pivotably connected with pins 70, retaining clips or rings 72 and washers 72*a*, for example similar to those seen in FIG. 3.

Figure 3:
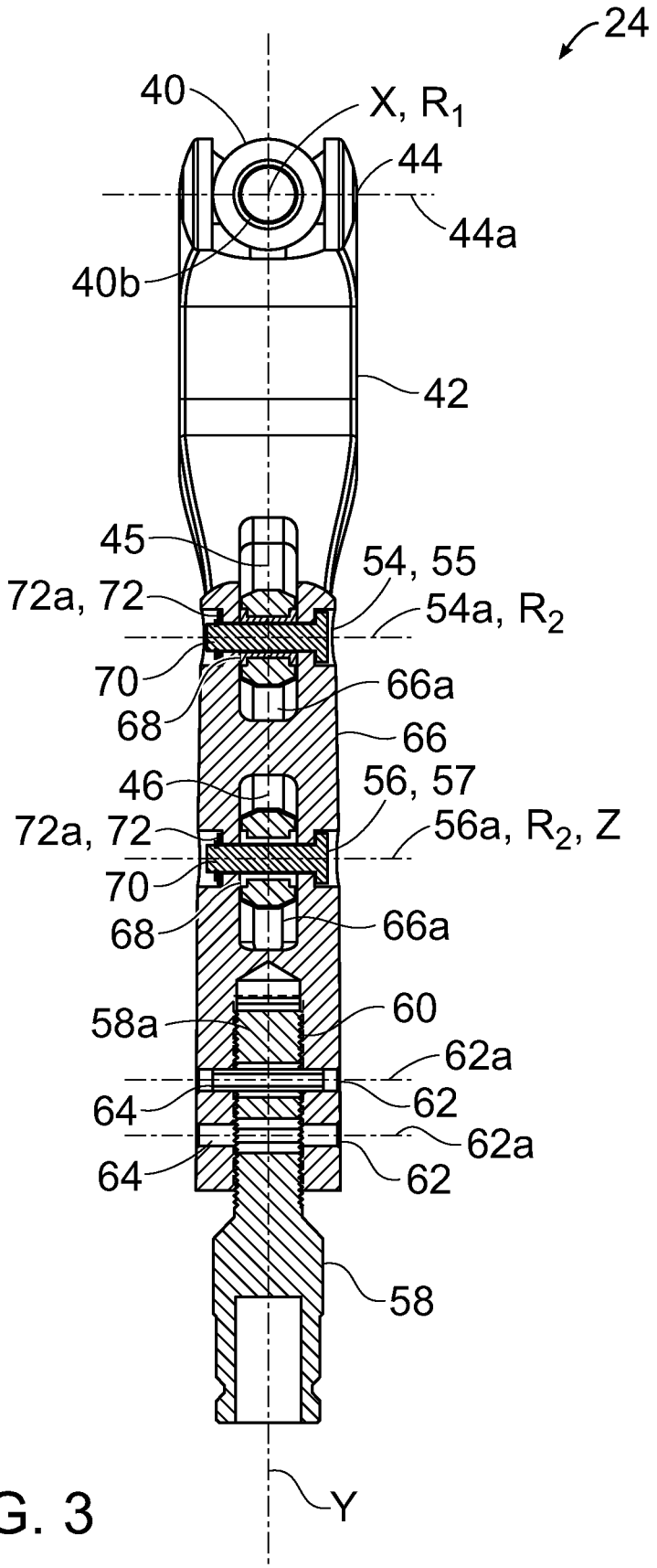
FIG. 3 is a sectional view of FIG. 2 taken along lines 3-3.

A center housing or central support member 66 can be rotationally or pivotably connected to the center of each parallel bar member 45 and 46 by first and second central pivots 54 and 56 that extend along respective axes 54*a* and 56*a*. Axes 54*a* and 56*a* can be spaced apart from each other along a longitudinal central axis of the central support member 66 and exercise handle 24 that extends centrally between the two side members 42, which can be axis Y. The central pivots 54 and 56 and respective axes 54*a* and 56*a* can extend in the Z axis direction, and can be aligned along and intersect respective bar member axes 50 and 51 orthogonally. The axes 48*a* and 54*a* corresponding to the bar member pivots 48 and central pivot 54 that are pivotably connected to the first parallel bar member 45, can be aligned along the longitudinal axis 50 of parallel bar member 45. The axes 52*a* and 56*a* corresponding to the bar member pivots 52 and central pivot 56 that are pivotably connected to the second parallel bar member 46, can be aligned along the longitudinal axis 51 of parallel bar member 46. Axes 43 and 41 of the side members 42 and axis Y of the central support member 66 can be parallel to each other. Referring to FIG. 3, the central pivots 54 and 56 can each include an axel or pin 70 inserted through a respective hole 55 and 57 in the central support member 66, and through bushing 68 within each parallel bar member 45 and 46. Each pin 70 can be secured in place by a retaining ring or clip 72 and a washer 72*a*. At least one slot or recess 66*a* (for example two) can extend through the central support member 66 in the region of central pivots 54 and 56 to provide clearance for pivoting of the parallel bar members 45 and 46 therein.

A connection, joining or adapter fitting or connector 58 can be secured to the proximal end of the central support member 66 along the central axis Y. The fitting 58 can have a threaded portion 58*a* that is engaged within a mating threaded hole 60 within the central support member 66, and secured or pinned by two securement fasteners or pins 64 through holes 62 along axes 62*a*. The fitting 58 can be secured or releasably securable to a rotatable component or connector 26*a* that can be at or secured to the distal end of the arm member 26 of the exercise device 10. Fitting 58 can have locking features such as locking grooves for locking thereto. The rotatable component 26*a* can include a bearing 27 that can provide the fitting 58 and exercise handle 24 with rotation about central axis Y. In some embodiments, the fitting 58 can include a rotational bearing 27 that provides the rotation.

Referring to FIGS. 4 and 5, during exercise by the user U (FIG. 1) in which 6 degree of freedom motions can be exercised, the handle member 40 can rotate about axis X or a first rotational axis $R_1$ in the direction of arrows 74. The handle member 40 can also tilt side to side as seen in FIGS. 4 and 5, to the left and to the right. By having the handle member pivots 44 and the bar member pivots 48 and 52 aligned along common respective axis 43 and 41 on each side member 42, as well as having the central pivots 54 and 56 and respective bar member pivots 48 and 52 aligned with each other along common respective axes 50 and 51, the handle member 40 and the two parallel bar members 45 and 46 can tilt or pivot together in unison and in parallel. As a result, the handle member 40 and axis X can stay parallel to the two parallel bar members 45 and 46 and their respective longitudinal axes 50 and 51 at all times, such as when at right angles to axis Y as well as during tilting. This arrangement of the pivots also allows the two parallel bar members 45 and 46 to rotate or pivot about respective axes 54*a* and 56*a* in the Z axis direction about second rotational axes $R_2$ in the direction of arrows 76. As can be seen during tilting, axes 41, 43 and Y of the respective side members 42 and central support member 66, can remain parallel to each other while being transverse to axes X, 50 and 51. The two spaced parallel bar members 45 and 46 can provide structural strength and rigidity to the exercise handle 24, for example in the Z direction, which can limit deflection, deformation or failure when subjected to heavy loads. In some embodiments, a single parallel bar member 45 or 46 can be employed. In such a case, the single parallel bar member and associated pivots can be increased in size and strength. The handle member 40 and exercise handle 24 can also rotate about central axis Y or a third rotational axis $R_3$ in the direction of arrows 78. The rotational bearing 27 can allow such rotation of the exercise handle 24 about axis Y. The simple robust design of exercise handle 24 with the three rotational axes $R_1$, $R_2$ and $R_3$, can allow a user U to conduct natural feeling 6 degree of freedom exercises while having the strength and rigidity to withstand high loads.

Figure 6:
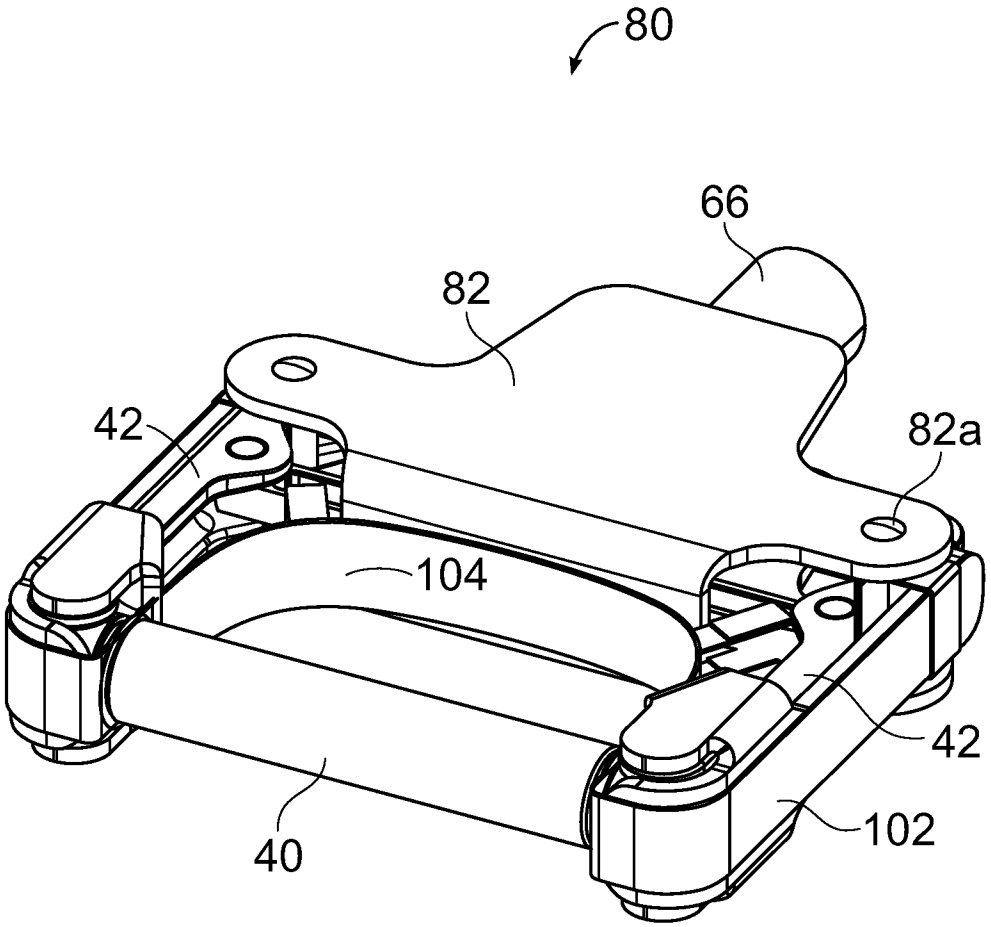
FIG. 6 is a perspective view of another embodiment of an exercise handle in the present disclosure.

FIG. 6 depicts another embodiment of an exercise handle 80 in the present disclosure that can be used with exercise device 10, which can include features that provide more comfort and safety to the user U, such as a center guard 82 held in place by fastener such as a button snap 82*a*, and a grip guard 104 to provide protection for the user's U knuckles. Exercise handle 80 can be similar to handle 24, but can have some differences.

Figure 7:
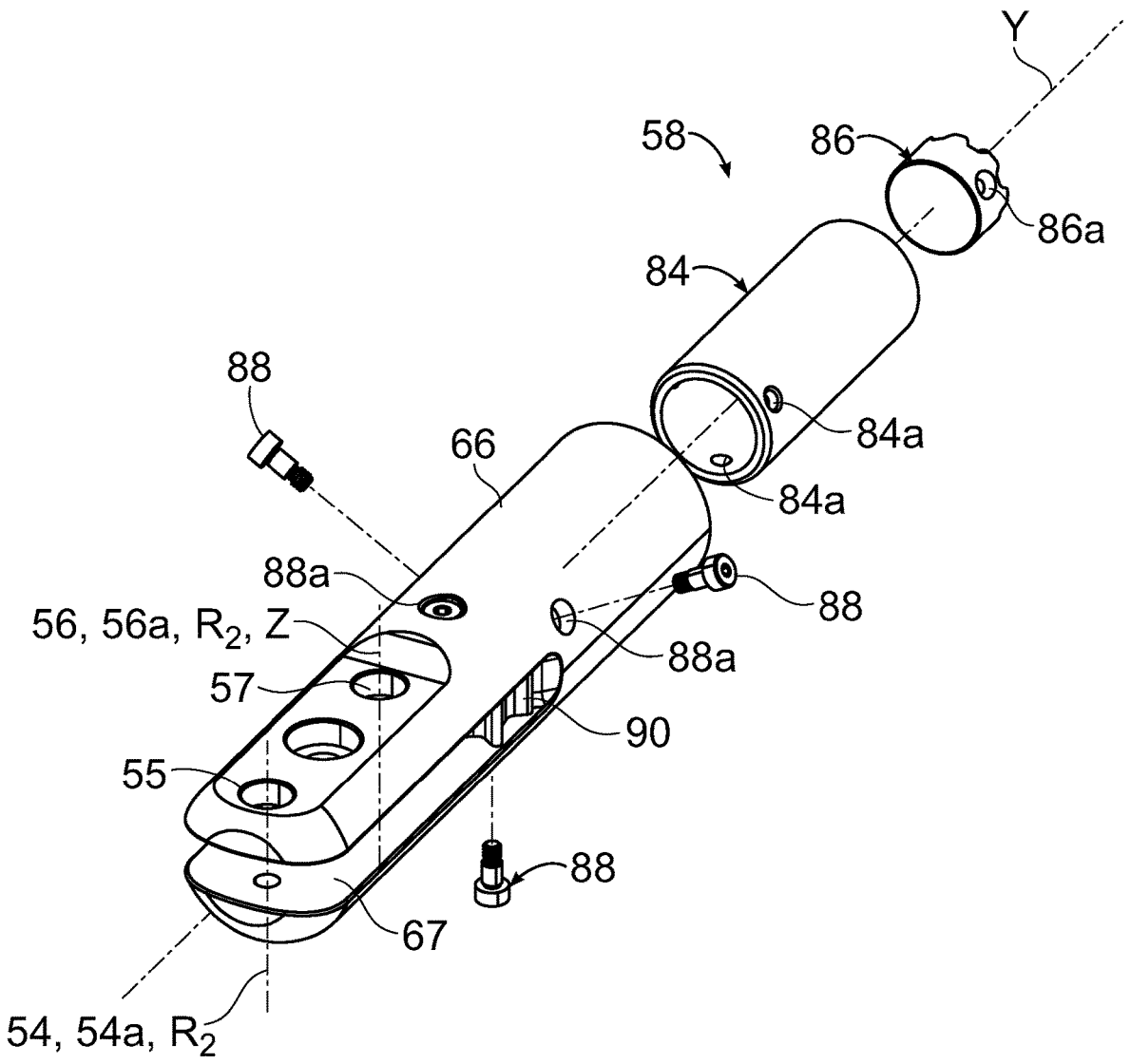
FIG. 7 is an exploded perspective view of a central support member and components for attachment.

Referring to FIG. 7, the central support member 66 can include a single recess or slot 67 for accepting the parallel bar members 45 and 46. A rubber bumper 90 can be secured in the proximal end of the slot 67 for providing cushioning for the parallel bar member 46 during pivoting. A connector or fitting 58 consisting of quick connect pieces, components or features 84 and 86, can be secured to the proximal end of the central support member 66 along axis Y by screws or fasteners 88 through holes 88*a*, 84*a* and 86*a*. The fitting 58 can be connected or secured, or releasably connectable or securable to a rotatable component or connector 26*a*, or can itself include a rotational bearing 27.

Figure 9:
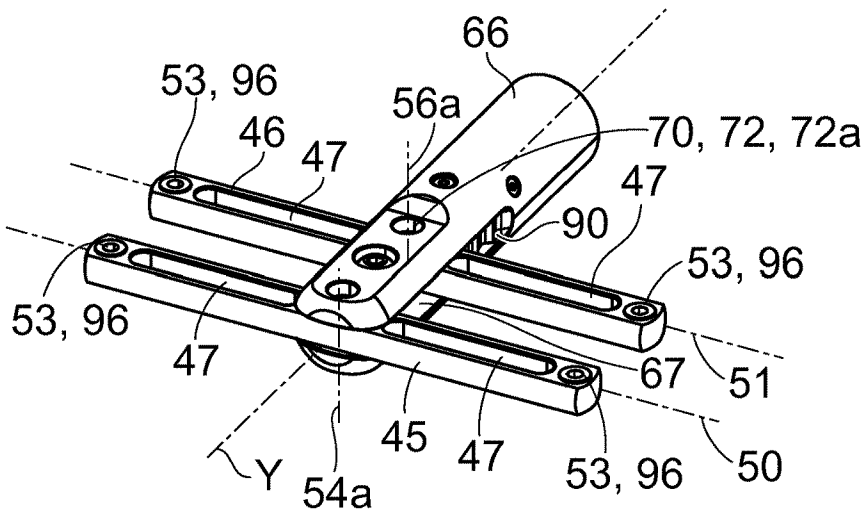
FIG. 9 is a perspective view of the components of FIG. 8 assembled.
Figure 8:
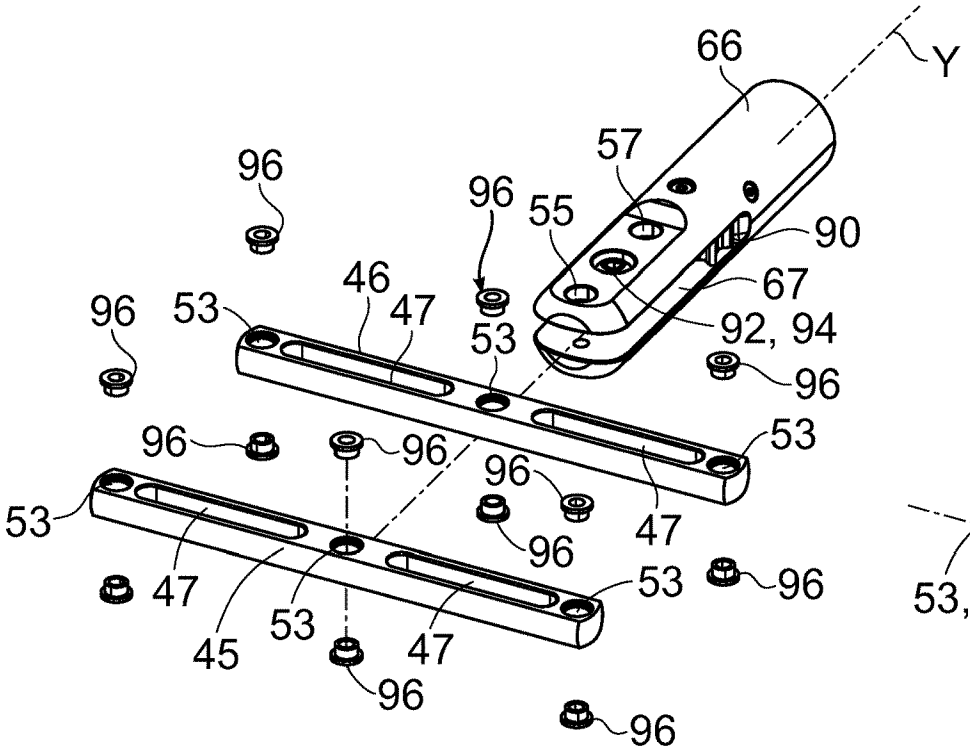
FIG. 8 is an exploded perspective view of the central support member and parallel bar members.

Referring to FIGS. 8 and 9, the parallel bar members 45 and 46 can each include two elongate slots 47 on opposite sides of central axis Y, and can have three pivot holes 53, one located in the center along axis Y, and the other two located on opposite distal ends. Two bushings 96 can be fitted or inserted into each pivot hole 53 on opposite sides. The parallel bar members 45 and 46 can be pivotably secured to the central support member 66 through holes 55 and 57 along respective axes 54*a* and 56*a*, each with a pin 70, retaining clip 72 and can further include a washer 72*a*.

Figure 10:
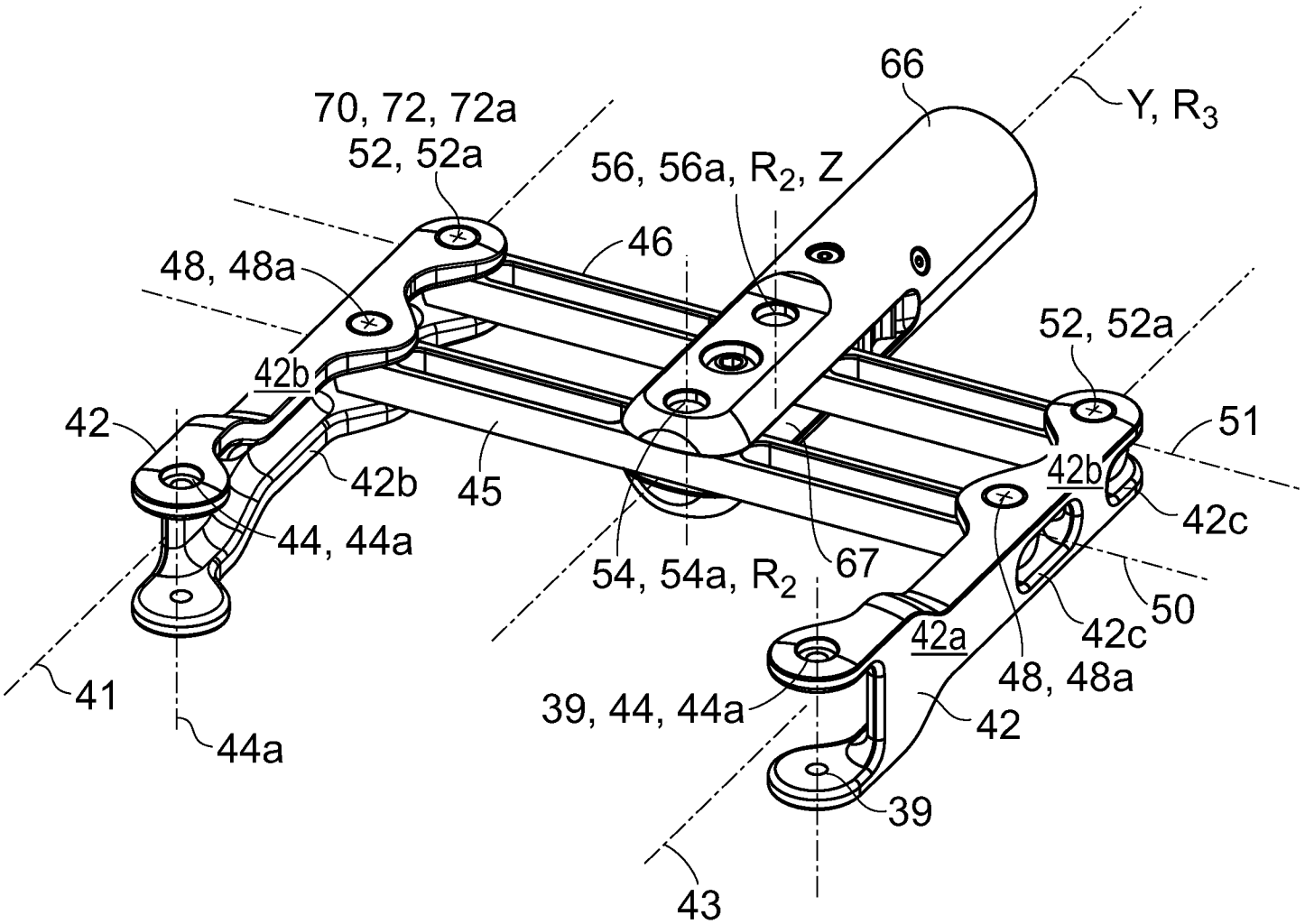
FIG. 10 is a perspective view showing side members assembled to FIG. 9.

Referring to FIG. 10, the side members 42 can be formed by suitable methods such as molding, stamping, casting or 3D printing, and can be generally elongate channel shaped. The side members 42 can have two spaced apart channel wings or sides 42*b* on opposite sides from each other and can be connected together by a channel web or base 42*a*. Holes for the pivots 44, 48 and 52 can extend through both wings 42*b*, and the wings 42*b* can increase in distance apart from each other in the region of the handle member pivots 44 to accommodate the handle member 40. The side members 42 can be pivotably secured to the parallel bar members 45 and 46 between the wings 42*b* by pins 70, retaining clips 72 and washers 72*a* at respective pivots 48 and 52. The holes for pivots 44, 48 and 52 can include counter bored holes 39 formed in the outer sides of each wing 42*b* to accept the pins 70, retaining clips 72 and washers 72*a*. Recesses, holes, openings or slots 42*c* can extend through the channel web 42*a* in regions of the pivots 48 and 52 for providing clearance for the distal ends of the parallel bar members 45 and 46 to pivot.

Figure 11:
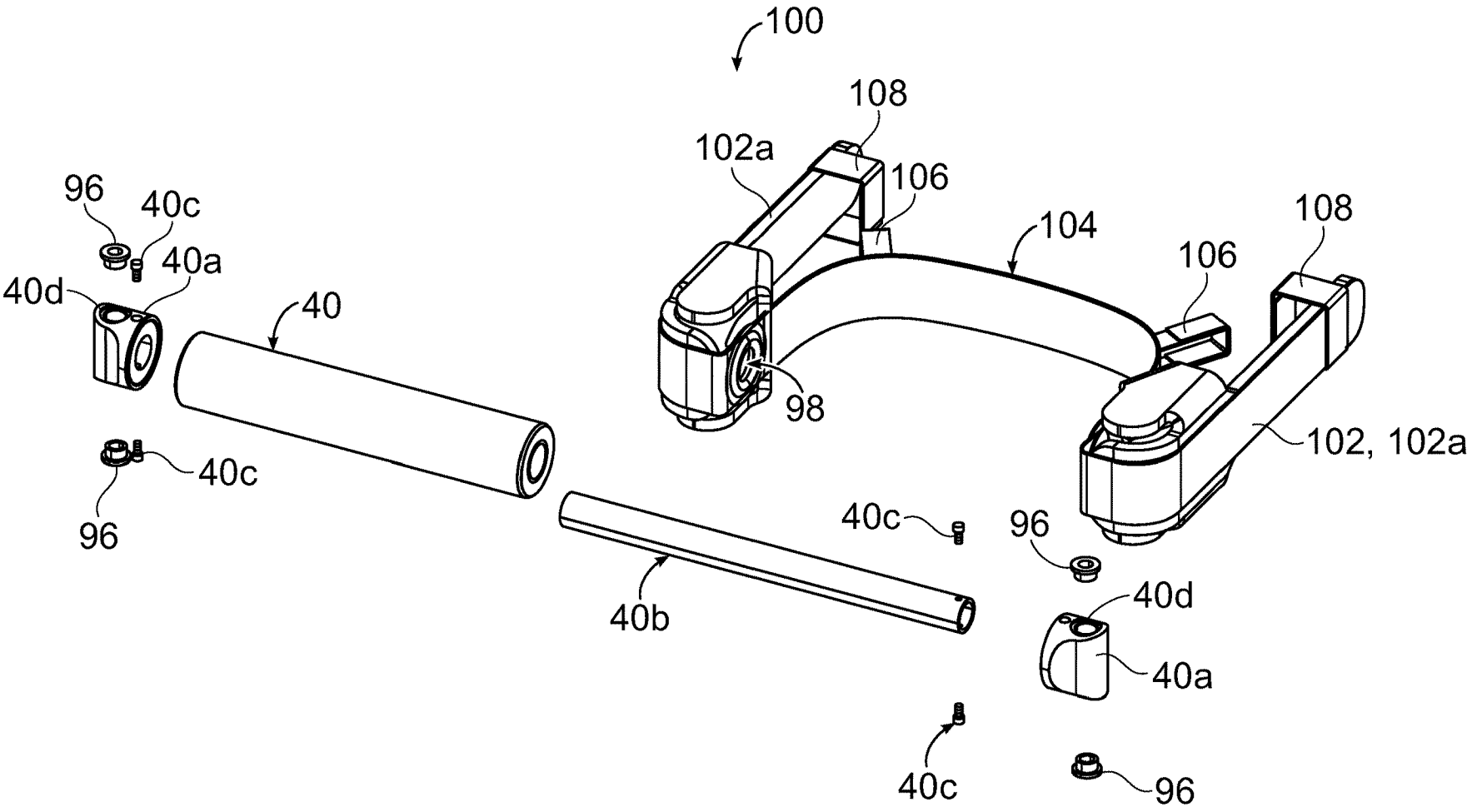
FIG. 11 is an exploded perspective view of a grip assembly.
Figure 12:
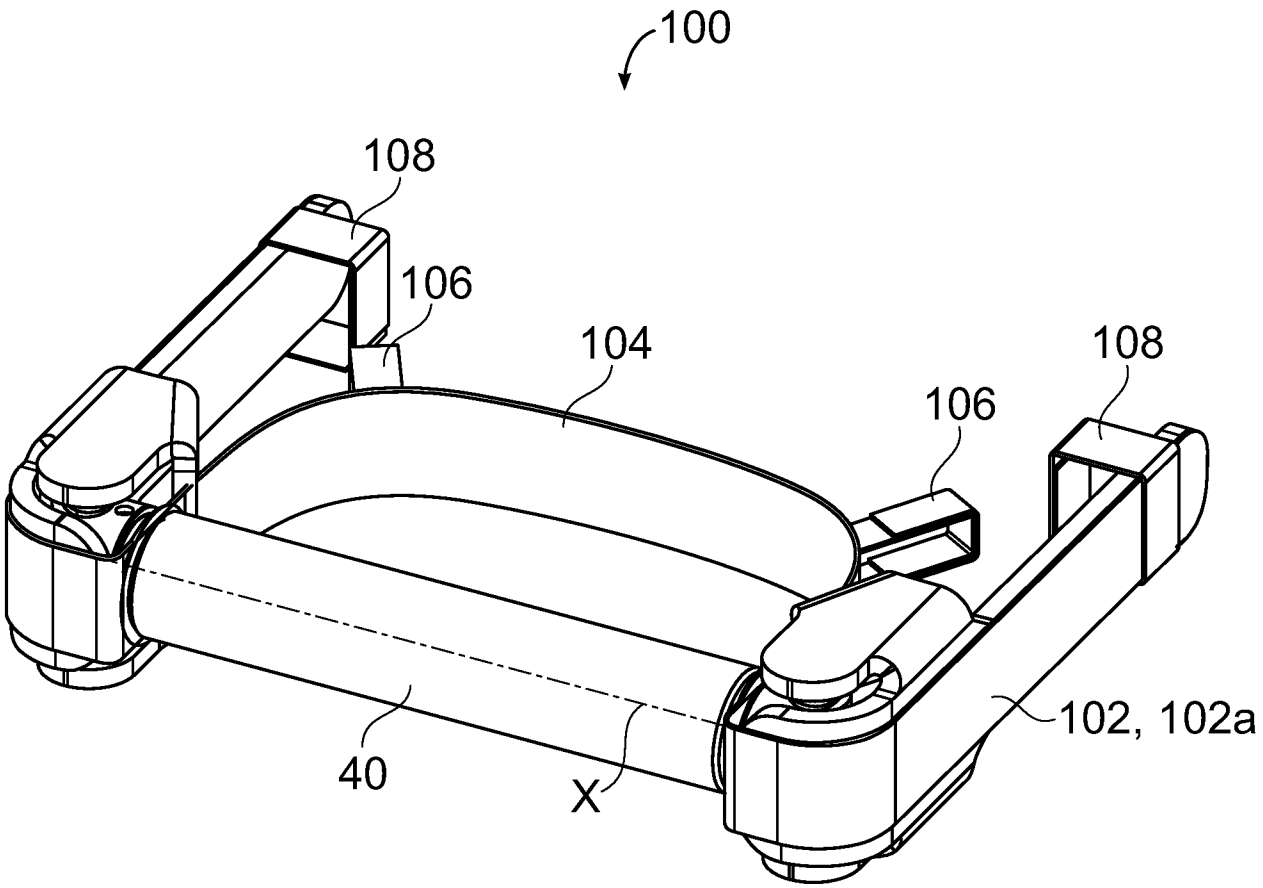
FIG. 12 is a perspective view of an assembled grip assembly.

Referring to FIGS. 11 and 12, a grip or handle assembly or subassembly 100 can be pre-assembled for assembly with the subassembly of components shown in FIG. 10. A handle support 102 can have two sides 102*a* extending on opposite sides from the grip guard 104. The distal ends of the sides 102*a* can include grommets, bushings or fittings 98 through which distal ends of the inner axel 40*b* for the handle member 40 can be inserted. The axel end caps 40*a* can be secured to the inner axel 40*b* by screws 40*c* and can be contained within the distal ends of the sides 102*a*. Two bushings 96 can be inserted into opposite sides of the hole 40*d* in each axel end cap 40*a*.

Figure 13:
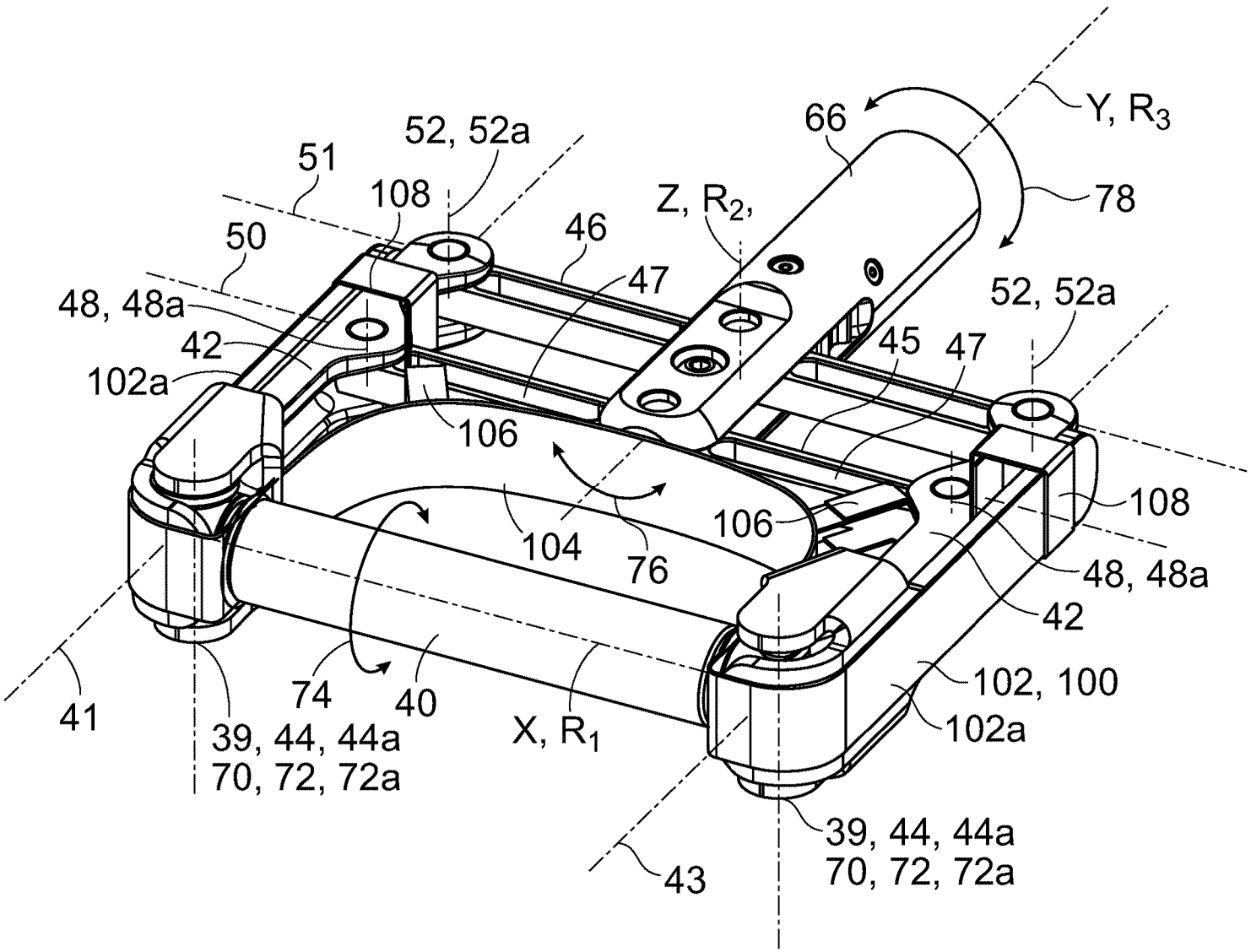
FIG. 13 is a perspective view of an assembled exercise handle without the center guard.

Referring to FIG. 13, the subassembly 100 can be attached to the assembly of FIG. 10 by connecting the axel end caps 40*a* of the handle member 40 to the holes 39 of the handle member pivots 44, through holes 40*d* in the axel end caps 40*a*, with pins 70, retaining clips 72 and washers 72*a*. The grip guard 104 can be attached to parallel bar member 45 by a securement device or strap 106 such as a hook and loop strap through each slot 47. The sides 102*a* can be secured to each side member 42 by a securement device or strap 108, which can be a hook and loop strap extending around each side member 42. The mechanics and operation of the exercise handle 80 can be similar to that of exercise handle 24 previously described above.

While example embodiments have been particularly shown and described, it will be understood by those skilled in the art that various changes in form and details may be made therein without departing from the scope of the embodiments encompassed by the appended claims. For example, various features of the different embodiments can be combined together or omitted. In addition, the size of the exercise handle in the present disclosure can vary, depending upon the size of the user, or if for use with one or two hands.

What is claimed is:

1. An exercise handle comprising:

a rotatable handle member pivotably connected between two side members by two handle member side pivots along respective handle member side pivot axes, the rotatable handle member also being rotatable between the two handle member side pivots about a longitudinal handle member axis that is orthogonal to and intersects the two handle member side pivot axes;

a parallel bar member pivotably connected between the two side members spaced away and parallel to the handle member, the parallel bar member being connected between the two side members by two bar member side pivots, the parallel bar member extending along a longitudinal bar member axis that is parallel to the longitudinal handle member axis;

a central support member pivotably connected to the parallel bar member by a central pivot, providing the handle member with side to side tilting relative to the central support member; and a central joint connected to the central support member for connecting to an exercise device.

2. The exercise handle of claim 1 wherein the parallel bar member comprises two parallel bar members, in which the two parallel bar members are pivotably connected between the two side members and spaced away and parallel to the handle member, each parallel bar member being connected between the two side members by two respective bar member side pivots, and to the central support member by respective central pivots.

3. The exercise handle of claim 2 in which the two parallel bar members are spaced apart from each other in a parallel manner, and the respective bar member side pivots and central pivots corresponding to each parallel bar member are aligned along respective common bar member axes.

4. The exercise handle of claim 3 in which the central support member includes at least one clearance recess for allowing each parallel bar member to extend through the central support member and tilt side to side therein.

5. The exercise handle of claim 4 in which the handle member side pivots connected to the handle member and the bar member side pivots connected to each parallel bar member on each side member, are aligned along respective common side member axes.

6. The exercise handle of claim 2 in which the handle member and the two parallel bar members remain parallel to each other when tilting side to side.

7. The exercise handle of claim 1 further comprising a rotational axis, in which the central joint provides at least one of rotation about said rotational axis, or connection to a component that provides rotation about said rotational axis.

8. An exercise handle comprising:

a rotatable handle member pivotably connected between two side members by two handle member side pivots;

two parallel bar members pivotably connected between the two side members spaced away and parallel to the handle member, each parallel bar member being connected between the two side members by two respective bar member side pivots;

a central support member pivotably connected to each parallel bar member by respective central pivots, providing the handle member with side to side tilting relative to the central support member; and a central joint connected to the central support member for connecting to an exercise device.

9. A method of exercise comprising:

gripping and rotating a rotatable handle member of an exercise handle that is attached to an exercise device, the rotatable handle being pivotably connected between two side members by two handle member side pivots along respective handle member side pivot axes, the rotatable handle member also being rotatable between the two handle member side pivots about a longitudinal handle member axis that is orthogonal to and intersects the two handle member side pivot axes, a parallel bar member being pivotably connected between the two side members by two bar member side pivots, and spaced away and parallel to the handle member, the parallel bar member extending along a longitudinal bar member axis that is parallel to the longitudinal handle member axis; and tilting the handle member side to side relative to a central support member, the central support member being pivotably connected to the parallel bar member by a central pivot, and connected by a central joint to the exercise device.

10. The method of claim 9 wherein the parallel bar member comprises two parallel bar members, the method further comprising tilting side to side the two parallel bar members pivotably connected between the two side members, and spaced away parallel to the handle member, each parallel bar member being connected between the two side members by two respective bar member side pivots, and to the central support member by respective central pivots.

11. The method of claim 10 in which during exercise, the two parallel bar members remain spaced apart from each other in a parallel manner, and the respective bar member side pivots and central pivots corresponding to each parallel bar member are aligned along respective common bar member axes.

12. The method of claim 11 in which the central support member includes at least one clearance recess for allowing each parallel bar member to extend through the central support member, the method further comprising allowing each parallel bar member to tilt side to side within the at least one clearance recess.

13. The method of claim 12 in which during exercise, the handle member side pivots connected to the handle member and the bar member side pivots connected to each parallel bar member on each side member, are aligned along respective common side member axes.

14. The method of claim 10 in which during exercise, the handle member and the two parallel bar members remain parallel to each other when tilting side to side.

15. The method of claim 9 further comprising rotating the exercise handle relative to a rotational axis extending from the exercise handle and to the exercise device, wherein the central joint provides at least one of rotation about the rotational axis, or connection to a component that provides rotation about said rotational axis.

16. A method of exercise comprising:

gripping and rotating a rotatable handle member of an exercise handle that is attached to an exercise device, the rotatable handle being pivotably connected between two side members by two handle member side pivots, two parallel bar members being pivotably connected between the two side members by two respective bar member side pivots, and spaced away and parallel to the handle member;

tilting the handle member side to side relative to a central support member, the central support member being pivotably connected to each parallel bar member by respective central pivots, and connected by a central joint to the exercise device; and tilting side to side the two parallel bar members pivotably connected between the two side members.

* * * * *